United States Patent [19]

Imamura et al.

[11] Patent Number: 4,906,966

[45] Date of Patent: Mar. 6, 1990

[54] TRIMMING RESISTOR NETWORK

[75] Inventors: Kaoru Imamura, Kawasaki; Wataru Takahashi, Negishi, both of Japan

[73] Assignee: Kabushiki Kaisha Toshiba, Kawasaki, Japan

[21] Appl. No.: 305,811

[22] Filed: Feb. 3, 1989

[30] Foreign Application Priority Data

Feb. 4, 1988 [JP] Japan ..... 63-22804

[51] Int. Cl.[4] ..... H01C 10/00

[52] U.S. Cl. ..... 338/195; 219/121.68

[58] Field of Search ..... 338/195, 203; 219/121.67, 121.68

[56] References Cited

U.S. PATENT DOCUMENTS

| | | | |
|---|---|---|---|
| 2,758,256 | 8/1956 | Eisler | 338/195 X |
| 3,431,640 | 3/1969 | Larsson | 338/195 X |
| 3,916,142 | 10/1975 | Ennis | 338/195 X |
| 3,983,528 | 9/1976 | King | 338/203 X |
| 4,338,590 | 7/1982 | Connolly, Jr. et al. | 338/195 X |
| 4,364,006 | 12/1982 | Makabe et al. | 338/195 X |

*Primary Examiner*—Bruce A. Reynolds
*Assistant Examiner*—M. M. Lateef
*Attorney, Agent, or Firm*—Finnegan, Henderson, Farabow, Garrett and Dunner

[57] ABSTRACT

A trimming resistor network includes first and second external connection terminals, a first resistor having two ends acting as first and second connection terminals, a first coupling body for connecting the first external connection terminal to the first connection terminal via series-connected resistors, a second coupling body for connecting the second external connection terminal to the second connection terminal directly or via series-connected resistors, and parallel trimming resistors having two ends respectively connected to the first and second coupling bodies. The combined resistance between the first and second external connection terminals is increased by substantially a preset amount each time one of the parallel trimming resistors is cut off.

9 Claims, 9 Drawing Sheets r2a + r2b = r2

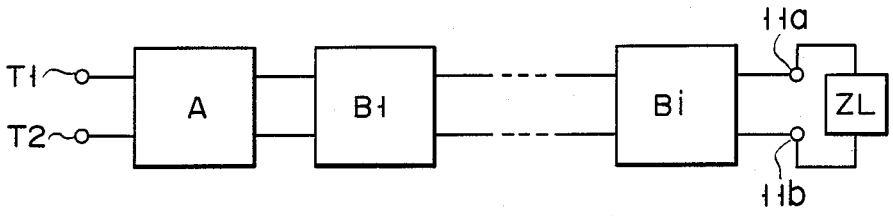
FIG. 10
FIG. 12A
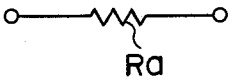
FIG. 12B
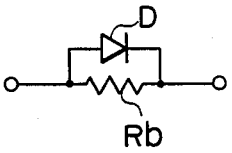
FIG. 12C
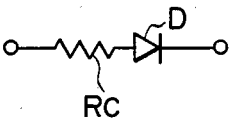
FIG. 12D
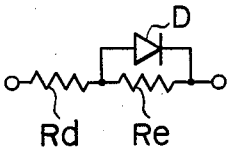
FIG. 12E
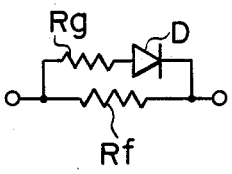

TRIMMING RESISTOR NETWORK

BACKGROUND OF THE INVENTION

1. Field of the Invention

This invention relates to a trimming resistor in a thin film or thick film integrated circuit, and more particularly to a trimming resistor network used for an output characteristic controlling device such as a digital converter.

2. Description of the Related Art

Recently, in the semiconductor integrated circuit and hybrid integrated circuit, the functional trimming has received much attention as a means for attaining precise output characteristics.

Since laser beam trimming is effected by use of a laser beam, it is not necessary to set the trimming device in electrical contact with trimmed material. Therefore, in a case where a resistor is used as the main factor for determining the output characteristic of the circuit, the resistance of the resistor is first set to a proper initial value and then the resistor is cut or processed by use of a laser beam while the circuit is set in the operative condition and the output characteristic is being observed. Thus, the resistance of the resistor can be adjusted until a desired output characteristic can be attained and therefore a high precision of output characteristic can be obtained. This resistance adjusting method is called the functional trimming.

Various trimming methods for adjusting the resistance have been proposed. The following two main methods are practiced. One of the trimming methods is to use short bars 2 respectively connected is parallel with series-connected diffusion resistor elements or thin film resistor elements 1 as shown in the circuit of FIG. 7A. Short bars 2 are sequentially cut apart (indicated by mark x) to adjust the resistance between two terminals A and B. The other trimming method is shown in FIG. 7B. FIG. 7B is a plan view of thin film resistor 4, and reference numeral 3 denotes a metal electrode. With this method, the resistance can be adjusted by forming groove 5 in the resistance film to change the direction of electric lines of force in the resistor film.

Now, the problem in the conventional technique is explained with reference to the functional trimming used in a semiconductor integrated circuit as an example.

In FIG. 7A, short bars 2 are generally formed of electrode wiring metal material such as Al. Since the metal material has high heat conductivity and a large light reflection factor, a large power laser beam is necessary when the laser beam is applied to the short bars to heat, melt and cut the same. In this case, if the short bars are arranged in a region of the semiconductor integrated circuit, the laser beam will be applied to the layer lying under the short bar immediately after the short bars are cut off by the laser trimming operation. Therefore, the underlying oxide film and semiconductor substrate may be destroyed. Further, the smallest variation in the surface condition of the metal material disposed in the short bar forming step will change the reflection factor thereof. In this case, the condition of application of the laser beam power required for cutting the short bar is changed and it is extremely difficult to effect the proper trimming without destroying the underlying layer.

In contrast, in the groove formation method of FIG. 7B, it is possible to process thin film resistor 4 without destroying the underlying layer by forming thin film resistor 4 of material such as polysilicon which has lower heat conductivity than metal. However, a small crack (called microcrack) 6 is formed in the processed fracture portion. The microcrack grows with heat or mechanical stress or absorbs moisture, causing variation in the resistance with time. The variation in the resistance with time is a fatal defect for a circuit used for adjusting the precise output characteristic by functional trimming.

In order to prevent variation in the resistance with time, there is provided a method in which thin film resistors are selectively cut off so as to prevent the electric line of force from crossing the fracture portion, to thereby adjust the resistance. In this case, if the trimming film resistors of the same resistance are connected in parallel, the amount of variation in the resistance for each cutting operation is not constant. For example, when 10 film resistors of 10 Ω are connected in parallel as shown in FIG. 8, the initial resistance between terminals A and B is 1 Ω. When one of the film resistors is cut off, the resistance increases by 0.1 Ω. However, when one of the two remaining film resistors is cut off, the resistance between terminals A and B changes from 5 Ω to 10 Ω, and thus the amount of variation is 5 Ω. That is, in this method, it is difficult to change the resistance by a desired amount as required.

Even with the above parallel circuit, it is possible to make the amount of resistance variation for each cutting operation constant. FIG. 9 shows an example of a network with which the resistance can be varied by 1 Ω for each cutting operation so as to change the resistance from 1 Ω to 10 Ω. The initial value of the combined resistance between terminals A and B is 1 Ω. The resultant resistance can be changed by 1 Ω by sequentially cutting off a resistor in a direction from the left to the right in the drawing so that the combined resistance can be changed from 1 Ω to 10 Ω. With this method, variation in resistance with time due to the presence of a microcrack will not occur. However, it is necessary to occupy a large area in order to form a film resistor having resistances of 2 Ω to 90 Ω. As a result, the cost increases because of increase in the chip area of the semiconductor integrated circuit, making it impossible to perform the method practically.

The conventional methods for changing the resistance of the trimmed resistor have the following problem. In the method described in FIG. 7A in which the short bar of good heat conductivity is cut off, the underlying layer may be damaged. Further, in the method of FIG. 7B in which a groove is formed in the resistor film, resistance variation wit time due to the presence of a microcrack may occur.

Further, in the method of FIG. 8 in which film resistors are connected in parallel and are sequentially cut off, the problem of microcracks can be solved but the amount of resistance variation unit in each cutting operation cannot be made constant. In this case, the resistance variation amount in each cutting operation may sometimes significantly exceed a variation amount required for attaining a desired output characteristic of the integrated circuit. In the method of FIG. 9, a constant resistance variation unit required for attaining a desired output characteristic can be obtained. In this case, however, the difference between desired resistance values of the film resistors constituting the network is large, and a large area is required for formation of the film resistors, making this method impractical.

SUMMARY OF THE INVENTION

An object of this invention is to provide a trimming resistor network which can be trimmed without damaging a layer lying under the trimming resistor, which solves the problem of causing resistance variation with time due to the presence of a microcrack, whose resistance can be changed by a predetermined amount in each trimming operation.

A trimming resistor network of this invention includes first and second external connection terminals; a first resistor having two ends acting as first and second connection terminals; a first coupling body for connecting the first external connection terminal to the first connection terminal via series-connected resistors; a second coupling body for connecting the second external connection terminal to the second connection terminal directly or via series-connected resistors; and parallel trimming resistors having two ends respectively connected to the first and second coupling bodies; wherein the combined resistance between the first and second external connection terminals is increased by a substantially constant amount each time one of the parallel trimming resistors is cut off.

When the trimming resistor networks are actually formed, the increasing amount of the resistance cannot be made constant because of fluctuation in the manufacturing process. The term "substantially constant amount" means a value in the range of permissible error defined by the specification of the product characteristic.

Further, in the trimming resistor network of this invention, each of the parallel trimming resistors can be formed of a polysilicon film doped with impurity, nichrome-series alloy film, tantalum-series metal film, polyimide organic film, acrylonitrile organic film, or ruthenium-series oxide film.

Now, the function of the trimming resistor network of this invention is explained in detail.

FIG. 1A is a circuit diagram of the network. The trimming resistor network is a two-terminal circuit having first external connection terminal T1 and second external connection terminal T2, and first resistor 11 (which is referred to as R1 and the resistance thereof is r1) is connected to the last stage of the network. Two ends of resistor R1 are respectively connected to terminals T1 and T2 via the first and second coupling bodies. As shown in FIG. 1B, each unit stage is formed of inverted L-shaped resistor 17 (surrounded by broken lines) which is constituted by connecting one end of first series resistor 12 (resistor R2 with resistance r2) to one end of parallel trimming resistor 15 (resistor R15 with resistance r3). A plurality of stages (six stages in FIG. 1A) of resistors 17 are cascade-connected. The other end of resistor R2 is used as third connection terminal 17*a*, the other end of resistor R3 is used as fourth connection terminal 17*b*, and the connection node between resistors R2 and R3 is used as fifth connection terminal 17*c*.

In a case where third connection terminal 17*a* of inverted L-shaped resistor 17 is arranged in the last stage, it is connected to connection terminal 11*a* of resistor R1. When it is arranged in a stage other than the last stage, it is connected to fifth connection terminal 17*c* of the succeeding stage. Fourth connection terminal 17*b* is connected to terminal T2 via second coupling body 14 and to second connection terminal 11*b* of resistor R1. Second series resistor 18 (resistor R4 with resistance r4) is connected between terminal T1 and fifth connection terminal 17*c* of first stage resistor 17. Combined resistance r when viewing resistor R1 from the fourth and fifth connection terminals is designed to be equal to r1. That is, r1, r2 and r3 are set to satisfy the following equation.

$$r = \frac{(r1 + r2) \cdot r3}{(r1 + r2) + r3} = r1 \qquad (1)$$

In FIGS. 1A and 1B, resistors attached with marks x are the trimming resistors, which can be cut off by the trimming operation.

The combined resistance between terminals T1 and T2 in the trimming resistor network of the above construction increases by substantially constant value r2 each time the parallel trimming resistors are sequentially cut off starting from that trimming resistor which is near terminals T1 and T2 towards the first resistor. As a result, the combined resistance can be changed from the initial value (r4+r1) to the final value (r4+r1+6r2).

In this case, resistor R2 determines constant variation value r2 of the combined resistance, and the number of inverted L-shaped resistors determines the entire range of the resistance variation.

Further, resistor R4 determines the initial value of the combined resistance and can be omitted when the function of the network of this invention is limited to the resistance adjusting function.

The resistances of resistors R1 and R3 must be set to satisfy equation (1). When r2 is previously determined, one of r1 and r3 or ratio r1/r3 can be freely determined. Therefore, r1 and r3 can be determined by taking the design condition and manufacturing condition into consideration so that the occupied area of the network can be suppressed to a minimum, for example.

The trimming resistor network shown in FIG. 2 is obtained by distributing part of resistors R2 of first series resistor 12 in the network of FIG. 1A to the second coupling body. That is, second coupling body 14 includes series-connected resistors via which second external connection terminal T2 is connected to second connection terminal 11*b* of first resistor 11. In the network of FIG. 2, r2a=pr2 and r2b=(1−p)r2, where p is a value for determining the distribution ratio and is smaller than 1. In this case, p can be determined to a desired value by taking the design condition and manufacturing condition into consideration. In FIG. 2, the same reference numerals as those in FIG. 1A are used to denote the same or similar parts shown in FIG. 1A, and the functions thereof are almost the same as those in FIG. 1A and the explanation thereof is omitted here.

FIG. 3A is a circuit diagram showing another example of the trimming resistor network of this invention. The network is a two-terminal network having first external connection terminal T3 and second external connection terminal T4. First resistor 51 (resistor R51 with resistance r51) is connected to the last stage of the network. First connection terminal 51*a* of resistor R51 is connected to terminal T3 via first coupling body 56 which includes first series resistor 52 (resistor R2q with resistance r2q), second series resistor 53 (resistor R2n with resistance r2n), third series resistor 54 (resistor R2m with resistance r2m and fourth series resistor 55 (resistor R21 with resistance r21). Second connection terminal 51*b* of resistor 51 is connected to terminal T4 via second coupling body 57. Further, parallel trimming resistor groups 58*m*, 58*n* and 58*q* are connected between second coupling body 57 and respective points of first coupling body 56.

As shown in FIG. 3B, parallel trimming resistor group 58*m* includes m parallel trimming resistors R31, R32, . . . , and R3*m* connected in parallel. When trimming resistors R31, R32, . . . , and R3*m* are sequentially cut off one by one in this order, the combined resistance between terminals T5 and T6 increases stepwise by constant value ro. In this case, resistances r31, r32, r33, . . . , r3m of respective resistors R31, R32, R33, . . . , R3*m* are set to (1×2)ro, (2×3)ro, (3×4)ro, . . . , m x (m+1)ro. Further, resistance r2m of resistor R2m is set to mro.

The resistances of the respective resistors in parallel trimming resistor group 58*n* and resistor R2*n*, and those of the respective resistors in parallel trimming resistor group 58*q* and resistor R2*q* are determined in the same manner as described above. In this case, n or q must be used instead of m. Resistance r51 of resistor R51 is set to constant resistance variation ro. In practice, resistors R2*q* and R51 may be formed of a single resistor R51 with a resistance of (r2q+ro).

In the trimming resistor network with the above construction, the combined resistance between terminals T3 and T4 is increased by constant value ro each time the parallel trimming resistors are sequentially cut off starting from that trimming resistor which lies near terminals T3 and T4 towards first resistor 51. In this case, the combined resistance can be changed from the initial value (r21+ro) to the final value {r21+ro+(m+n+q)ro} by a stepwise variation of ro. The resistance of resistor R2m is set to be equal to total amount mro of increase in the combined resistance which is obtained when the resistors of the preceding parallel trimming resistor group are cut off. After the resistors of the preceding parallel trimming resistor group are cut off, the resistance of resistor R2m is added to resistor R21. Therefore, the design condition for the succeeding resistor group 58*n* can be set to be substantially the same as that for the first stage resistor group 58*m*. This applies to resistors R2*n* and R2*q*.

In general, m, n and q are set to 1, 2 or 3, and the resistances of the parallel trimming resistors of the trimming resistor network are respectively set 2ro, 6ro and 12ro, for example. Thus, the difference between the resistances of the resistors used can be suppressed, and therefore an increase in the chip area required for forming the trimming resistor network can be avoided. The resistance of first resistor 51 is determined by resistance variation unit ro, and resistor R21 determines the initial value of the combined resistance of the resistor network but can be omitted as required.

Further, as shown in FIG. 2, it is possible to distribute part of resistors R2*l*, R2*m* to R2*q* of first coupling body 56 in corresponding portions of second coupling body 57. In this example, three stages of resistor groups 58*m*, 58*n* and 58*q* are used, but the number of the stages of the resistor groups can be selectively set.

In the network of this invention, the parallel trimming resistors are formed of resistor films of polysilicon films doped with impurity or nichrome-series alloy films whose heat conductivity is smaller than the metal of the conventional short bar. Therefore, it is possible to use a low power laser beam and reduce the possibility of destroying the underlying layer in the cut-off process.

BRIEF DESCRIPTION OF THE DRAWINGS

FIG. 10 is a circuit diagram showing a trimming resistor network of this invention in the form of 4-terminal circuit blocks;

FIGS. 12A to 12E are circuit diagrams showing examples of impedance elements Z1 to Z33 of FIGS. 11A to 11L, FIG. 12A showing an impedance element formed of only a resistor (linear element) and FIGS. 12B to 12E showing impedance elements including diodes (nonlinear elements) which are made conductive or nonconductive according to the polarity of a voltage applied between terminals T1 and T2 of FIG. 10;

DETAILED DESCRIPTION OF THE PREFERRED EMBODIMENTS

Figure 1A:
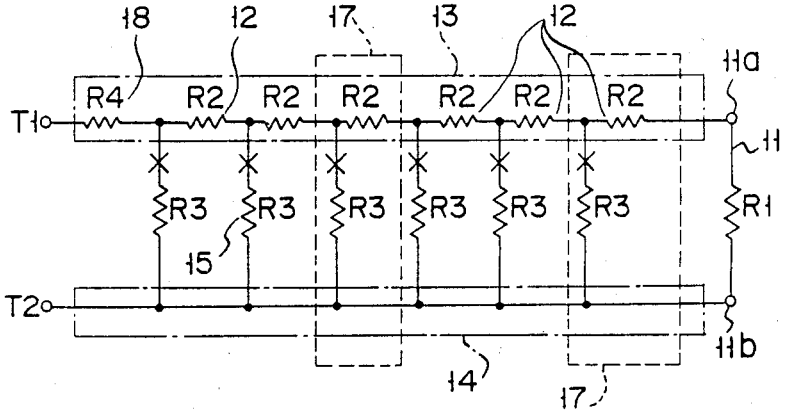
FIG. 1A is a circuit diagram showing a concrete example of a trimming resistor network of this invention.
Figure 1B:
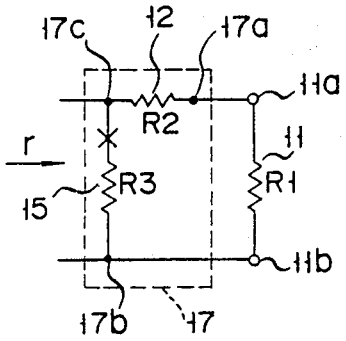
FIG. 1B is a circuit diagram showing part of the network of FIG. 1A to illustrate the function thereof.
Figure 4A:
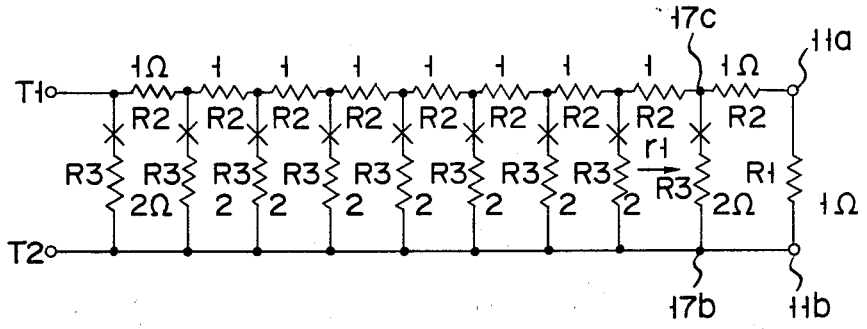
FIGS. 4A and 4B are circuit diagrams showing an embodiment of the trimming resistor network of this invention shown in FIG. 1A.

FIG. 4A is a circuit diagram showing one embodiment of the trimming resistor network shown in FIG. 1A. In FIG. 4A, the same reference numerals as are used in FIG. 1A denote the same or similar portions and the explanation thereof is omitted. In the network in FIG. 4A, the resistance is adjusted in 1 Ω steps from 1 Ω to 10 Ω. Generally the network is connected in series with a resistor (not shown) to be adjusted and is used to set the resistance of the resistor to a desired value. Therefore, resistor R4 used in FIG. 1A to determine the initial value is omitted. Since the resistance variation unit is 1 Ω, r2 is set at 1 Ω. In order to set the combined resistance when viewing resistor R1 from connection terminals 17*c* and 17*b* of the final stage inverted L-shaped resistor to r1, it is necessary to set r1 and r3 so as to satisfy equation (1). If 1 is used in place of r2 in equation (1), the following equation can be obtained.

$$r3=r1(r1+1) \quad (2)$$

Based on equation (2), r1 is set to 1 Ω and r3 is set to 2 Ω by taking the design and manufacturing conditions into consideration. Further, 9 stages of inverted L-shaped resistors are cascade-connected in order to set the resistance variation range of 1 Ω to 10 Ω.

Figure 4B:
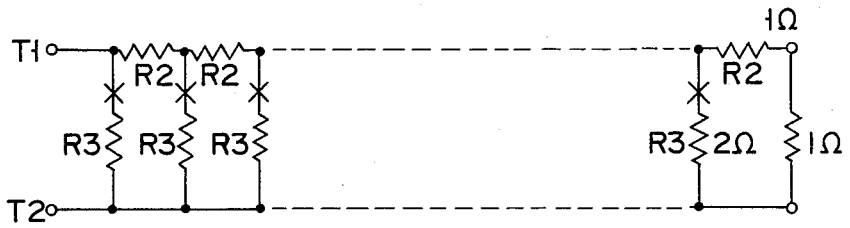

The combined resistance, viewing from connection terminals 17*c* and 17*b* of the final stage inverted L-shaped resistor (the right side in FIG. 4A) to the side of resistor R1, is set to 1 Ω. That is, a circuit obtained by connecting a resistor (R1) of 1 Ω to the final stage inverted L-shaped resistor becomes equal to a resistor of 1 Ω. Thus, the equivalent resistor of 1 Ω is connected to the eighth inverted L-shaped resistor. As a result, the combined resistances between terminals T1 and T2 in the networks shown in FIGS. 4A and 4B are equivalent to each other. The same consideration of attaining the equivalent circuit can be applied to the preceding stage towards the first stage. Therefore, the resistance when viewed from left to right from terminals 17*c* and 17*b* in each stage of the inverted L-shaped resistor becomes 1 Ω, and thus the combined resistance between terminals T1 and T2 is 1 Ω.

When the first stage parallel trimming resistor R3 is cut off, the combined resistance between terminals T1 and T2 becomes equal to the sum of 1 Ω of the first stage resistor R2 and a resistance of 1 Ω obtained from the next stage resistor, as viewed from left to right from connection terminals 17*c* and 17*b*, that is, 2 Ω. Each time the parallel trimming resistors are cut off towards the final stage resistor, 1 Ω of the preceding resistor R2 is added so that the resistance between terminals T1 and T2 can be changed from 1 Ω to 10 Ω in 1 Ω steps.

Figure 3A:
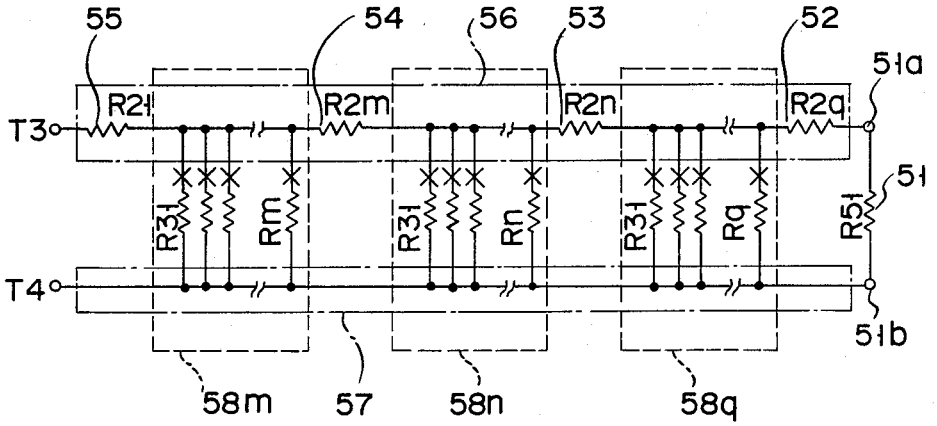
FIG. 3A is a circuit diagram showing another concrete example of a trimming resistor network of this invention.
Figure 3B:
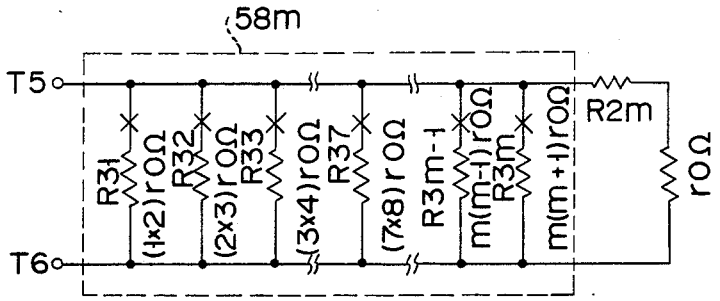
FIG. 3B is a circuit diagram showing part of the network of FIG. 3A to illustrate the function thereof.
Figure 5A:
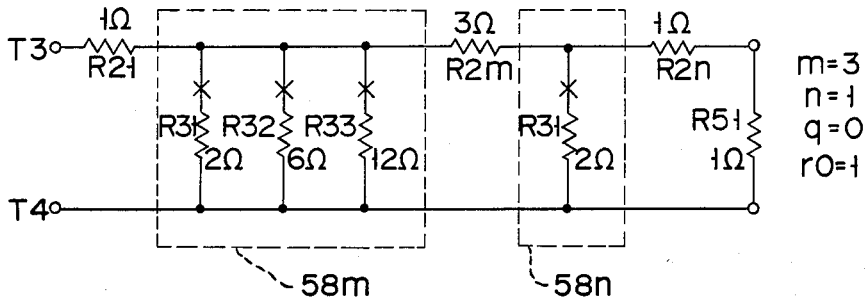
FIGS. 5A and 5B are circuit diagrams showing an embodiment of the trimming resistor network of this invention shown in FIG. 3A.

Next, the embodiment of the trimming resistor network shown in FIG. 3A is explained with reference to FIG. 5A. In FIG. 5A, the same reference numerals as used in FIG. 3A denote the same or similar portions and the explanation thereof is omitted. In the network, the combined resistance between terminals T3 and T4 can be chanted from 2 Ω to 6 Ω in 1 Ω steps. In this case, the total number (m+n+q) of parallel trimming resistors is 4 and variation unit ro is 1 Ω. In this example, m, n and q are respectively set to 3, 1 and 0 by considering the design and manufacturing conditions.

Since m=3, resistances r31, r32, and r33 of three parallel trimming resistors R31, R32 and R33 of the first stage parallel trimming resistor group 58*m* are respectively set to r31=2ro=2 Ω, r32=(2×3)ro=6 Ω, and r33=(3×4)ro=12 Ω. Since the total increase amount mro of the combined resistance when parallel trimming resistor group 58*m* is cut off is 3×ro=3 Ω, then r2m is set to 3 Ω.

In the succeeding stage parallel trimming resistor group 58*n*, n=1. Therefore a single parallel trimming resistor with resistance of r31=2ro=2 Ω is used and r2n is set to 1 Ω.

Further, r51 of first resistor R51 is set to be equal to variation unit ro, that is, 1 Ω. Since initial resistance (r21+ro) is 2 Ω, r21 is 1 Ω.

Figure 5B:
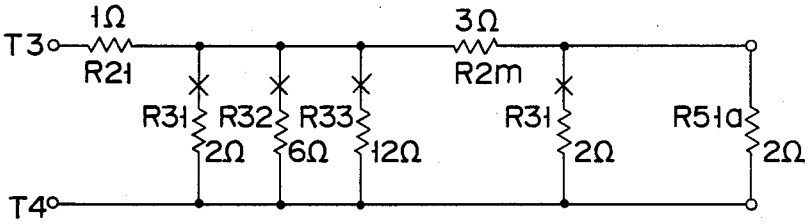

In may cases, resistors R2n and R51 are formed as a single resistor with the resistance of (r2*n*+r51)=2 Ω as shown in FIG. 5*b*.

The initial combined resistance between terminals T3 and T4 of the network with the construction shown in FIG. 5A is 2 0. When the parallel trimming resistors are sequentially out off one by one from that one which is to the right of terminals T3 and T4, from left to right in the drawing, the combined resistance between terminals T3 and T4 is changed in 1 Ω steps until the final resistance of 6 Ω is obtained. The number of stages of the parallel trimming resistor groups and the number of parallel trimming resistors constituting the parallel trimming resistor group can be selectively set by considering the design and manufacturing conditions. Therefore, a large degree of freedom can be attained.

Figure 6A:
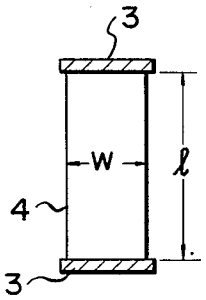
FIGS. 6C are plan views illustrating the main factors for determining the resistance of a film resistor.
Figure 6B:
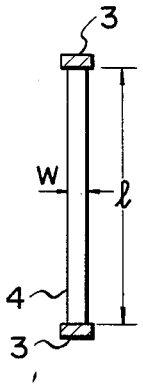
Figure 6C:
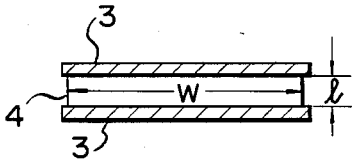

The resistor used in this invention is formed of a thin or thick film, and the resistance of the film resistor is determined by resistivity p(Ω·cm), film thickness t, film length l and film width w of film 4 as shown in FIG. 6A. It is a common practice to obtain desired resistances of resistor films by setting p and t to preset values and changing l and w. In this case, a high resistance film can be obtained by increasing l and reducing w as shown in FIG. 6B. At this time, w has a lower limitation due to the fine pattern technique. Therefore, in order to form a higher resistance film, it is necessary to further increase l. However, increase in l necessitates a large occupied area for formation of the resistor film. Further, a low resistance film can be formed by reducing l and increasing w as shown in FIG. 6C. In this case, l has a lower limitation due to the fine pattern technique. Therefore, in order to form a lower resistance film, it is necessary to further increase w. However, increase in w necessitates a large occupied area for formation of the resistor film. Therefore, in determining the shape and dimensions of the film resistor, it is necessary to consider the design and manufacturing conditions and the like.

As is clearly understood from the above-described embodiments, in the trimming resistor network of this invention, a degree of freedom for determination of the resistances of resistors for attaining a desired resistance variation is large and therefore the occupied area required for forming the network can be reduced.

The parallel trimming resistors in the above embodiment are formed of polysilicon films doped with impurity and can be selectively cut off by application of a laser beam. Therefore, the possibility of damaging the underlying layer the time of cutting-off operation by the laser beam can be significantly reduced in comparison with the conventional case wherein metal such as Al with high heat conductivity is cut off. The same effect can be obtained by using one of a nichrome-series alloy film, tantalum-series metal film, polyimide organic film, acrylonitrile organic film and ruthenium-series oxide film which have lower heat conductivity that a metal such as Al.

FIG. 10 is a circuit diagram generally showing in a 4-terminal network form a trimming resistor network of this invention. FIGS. 11A–11L respectively shows the contents of 4-terminal network blocks in FIG. 10. 4-terminal network block A in FIG. 10 can have the circuit of FIG. 11A, for example. In this circuit when pure resistor R4 is used as impedance element Z1, resistor R4 of FIG. 1A or FIG. 2 constitutes 4-terminals network block A. Further, each of 4-terminal network blocks Bl-Bi in FIG. 10 can have the circuit of FIG. 11F. In this circuit if pure resistor R3 and R2 (or R2*a*) are used as impedance elements Z10 and Z11, respectively, resistors R3 and R2 in FIG. 1A or resistors R3 and R2*a* in FIG. 2 constitute 4-terminal network block Bl-Bi.

Figure 7A:
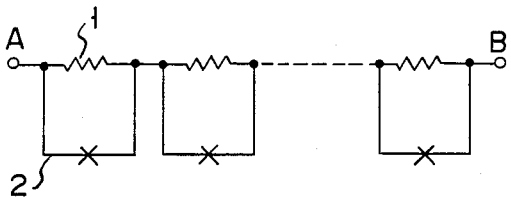
FIG. 7A (PRIOR ART)
FIG. 7A is a circuit diagram illustrating the conventional trimming method for changing the resistance.
Figure 7B:
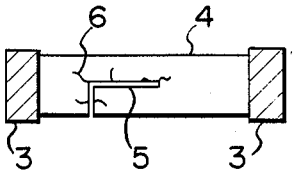
FIG. 7B (PRIOR ART)
FIG. 7B is a plan view showing a trimming resistor film having a groove formed therein.
Figure 8:
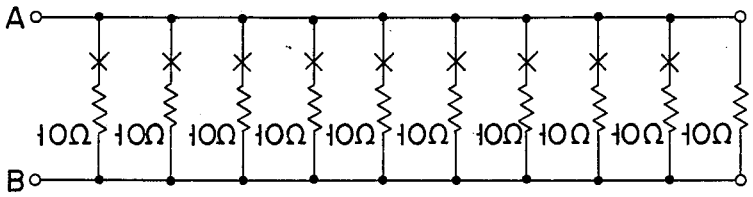
FIG. 8 (PRIOR ART)
FIGS. 8 and 9 are circuit diagrams illustrating the problems of the conventional trimming resistor network.
Figure 9:
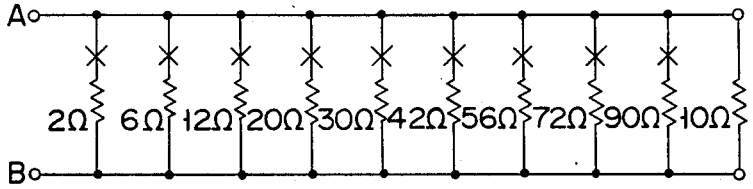
FIG. 9 (PRIOR ART)
Figure 11A:
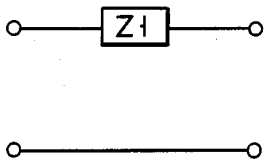
FIGS. 11A to 11L are circuit diagrams showing the construction of each 4-terminal circuit block in FIG. 10.
Figure 11B:
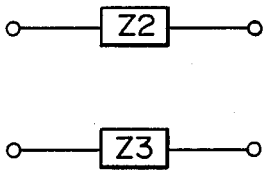
Figure 11C:
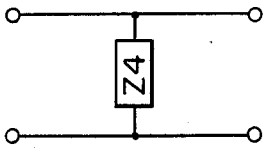
Figure 11D:
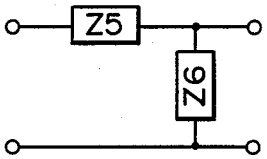
Figure 11E:
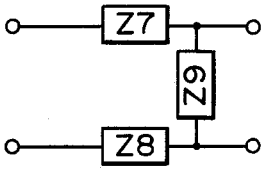
Figure 11F:
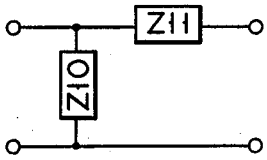
Figure 11G:
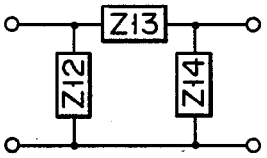
Figure 11H:
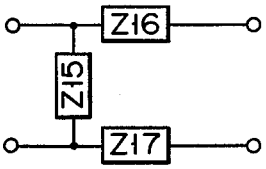
Figure 11I:
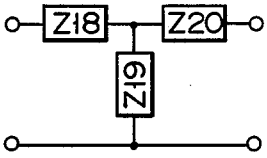
Figure 11J:
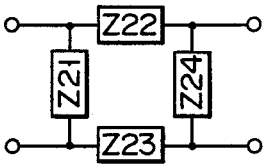
Figure 11K:
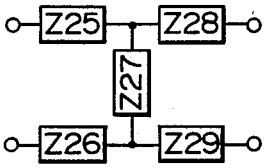
Figure 11L:
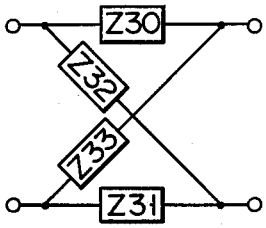

Similarly, except for the conventional combinations shown in FIGS. 7-9, each 4-terminal network block in FIG. 10 can be constituted by an optical combination of the circuit of FIGS. 11A-11L.

FIGS. 12A-12E show contents of impedance elements Z1-Z33 in FIGS. 11A-11L. FIG. 12A shows pure resistor (linear element) Ra only. FIGS. 12B-12E show resistor circuits each of which includes diode (non-linear element) D. The condition of conductiving/non-conducting of diode D depends on the voltage polarity applied to terminals T1 and T2 in FIG. 10. (Note that the circuit connection of the direction of diode D in FIGS. 12B-12E may be inversed.)

Any of the circuits in FIGS. 12A-12E can be used as the impedance elements in respective 4-terminal network blocks A and Bl-Bi, and each of these networks can be constituted by any combination of FIGS. 11A-11L. (Not that diode D in FIGS. 12B-12E can be replaced with, or used together with an active element or switching element such as a transistor.)

Figure 13:
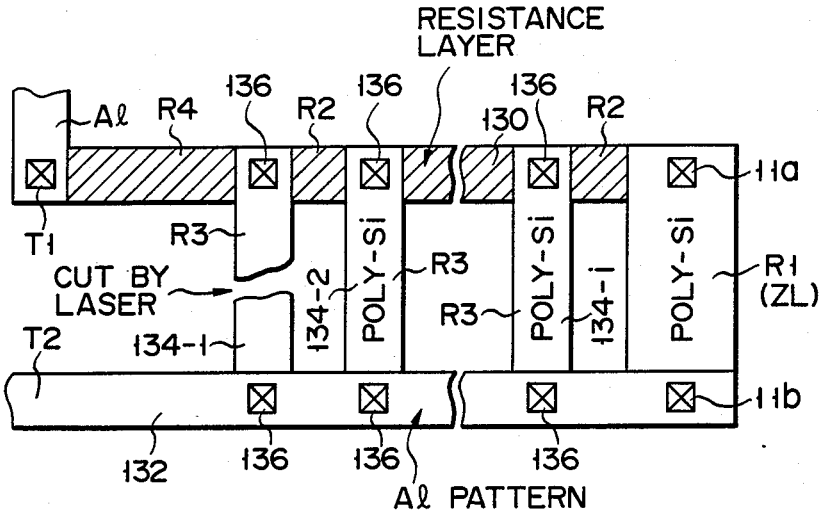
FIG. 13 shows the construction of the resistor network of FIG. 1A, for example, formed in an IC and including a diffusion resistance layer diffused in the semiconductor substrate, an aluminum wiring layer and a polysilicon resistance layer spanning between the diffusion resistance layer and aluminum wiring layer.

FIG. 13 shows an arrangement of the resistor network of, for example, FIG. 1A, which is formed in an IC. In a semiconductor substrate (not shown), resistor layer 130 is formed by a diffusion. Al wiring layer 132 is formed on the substrate in parallel to diffusion resistor layer 130. Layers 130 and 132 are bridged like a ladder, via doped polysilicon resistor layers 134-*l* to 134-*i*, to which high-concentration impurities are doped.

Respective polysilicon resistor layers 134-*l* to 134-*i* are electrically connected to layers 130 and 132, via contacts 136. both ends of layers 130 and 132 are terminated by polysilicon resistor layer R1, via contacts 11*a* and 11*b*.

In the above description, the materials used for layers 130, 132, and 134 are different from one another. However, the same material can be used for all these layers. For instance, all of layers 130, 132, and 134 can be high-impurity-concentration doped polysilicon resistor layers or a metal resistor film of tantalum or the like. In this case, contacts 136 in FIG. 13 may be omitted. The resistor network of FIG. 2 can be suitably constituted by the configuration in which the same material is used for all layers 130, 132, and 134. (Incidentally, the resistor network of FIG. 1A can be suitably constituted by a configuration in which layer 132 is made of an Al wiring layer, while layers 130 and 134 are both resistor layers.)

Figure 2:
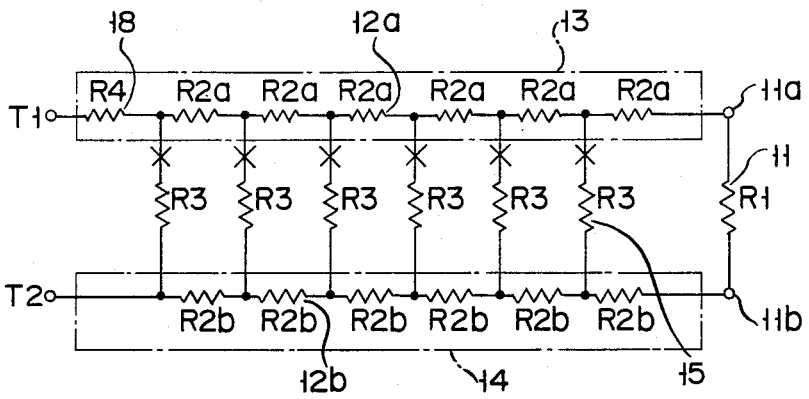
FIG. 2 is a circuit diagram showing a modification of the network of FIG. 1A.
Figure 14:
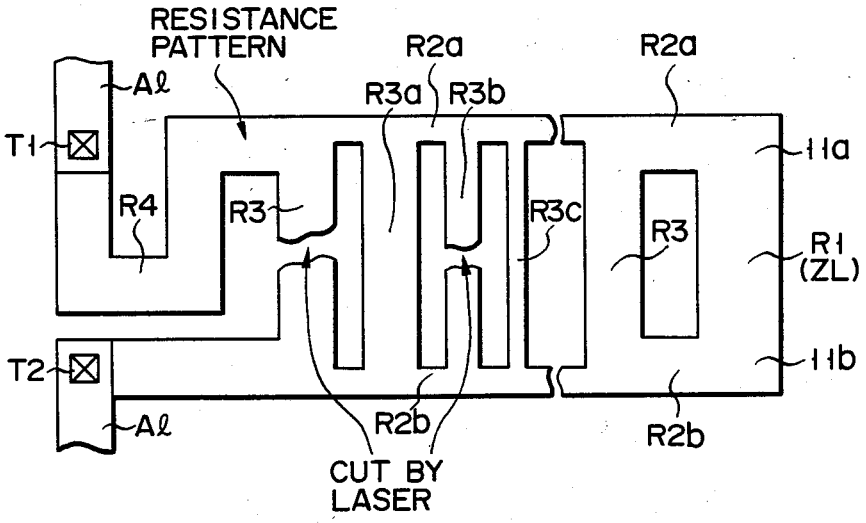
FIG. 14 shows the construction of the resistor network of FIG. 2, for example, formed in an IC by patterning a metal film or the like formed on the semiconductor substrate.

FIG. 14 shows a configuration in which the resistor network of, e.g. FIG. 2, is integrated into an IC by patterning a metal film layer formed on a substrate thereof. In the configuration of FIG. 14, optical resistance values can be obtained for resistors R1-R4, by suitably changing widths of the metal resistor patterns.

Figure 15:
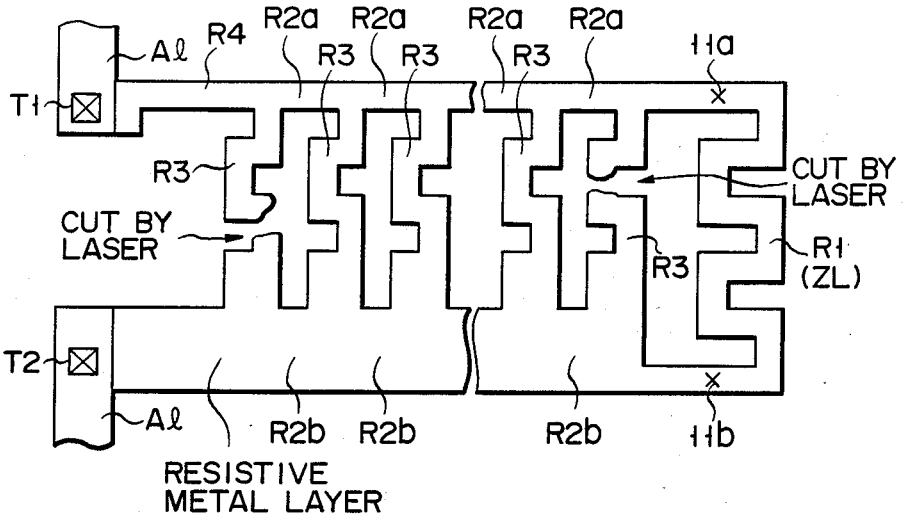
FIG. 15 is a modification of FIG. 14 in which trimming resistors of relatively high resistance can be obtained by making the resistor pattern complex without increasing the pattern area.

FIG. 15 shows a modification of FIG. 14. In this modification, the effective length of a metal resistor film pattern is elongated by intentionally compricating the figure or shape of the pattern. According to the embodiment of FIG. 15, relatively high-resistance trimming resistors can be obtained without excessively increasing the pattern area.

Figure 16:
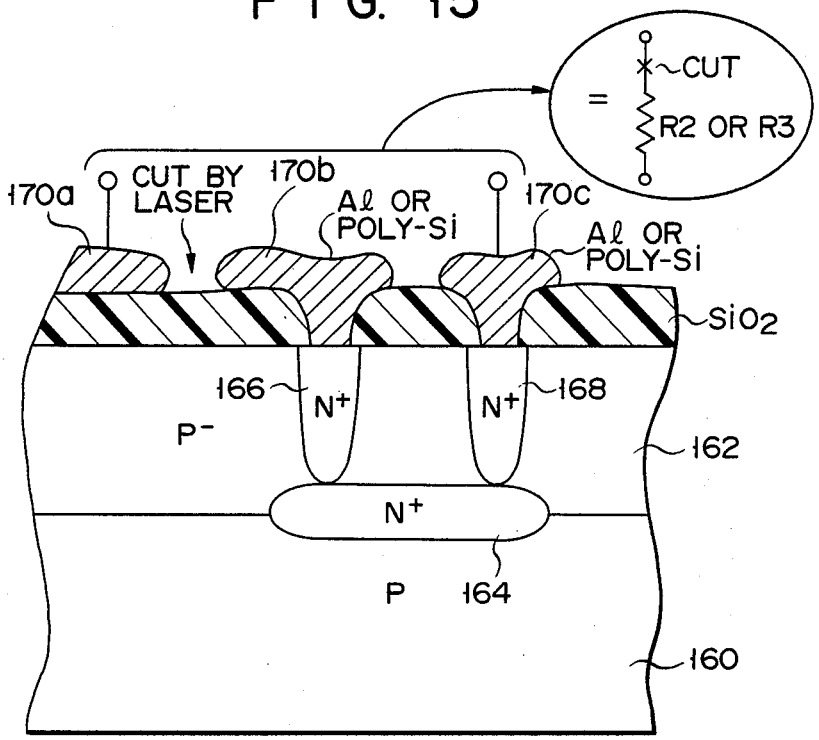
FIG. 16 shows the construction of the trimming resistor of, for example, FIG. 1A by using an impurity concentration buried layer formed in a semiconductor substrate.

FIG. 16 is a sectional view of a semiconductor substrate in which trimming resistors R2 and/or R3 of FIG. 1A, etc. are formed.

More specifically, N+ buried layer 164 is formed at the boundary between P substrate 160 and P− epitaxial layer 162. (A diffusion layer, doped polysilicon layer, etc. can be used for buried layer 164.) After forming the buried layer, N type impurities (e.g. phosphorus) are ion-implanted from the surface of epitaxial layer 162, so that N+ layers 166 and 168 are formed to reach the buried layer 164. N+ layers 166, 164, and 168 are electrically series-connected to form a trimming resistor body.

N+ layer 166 is connected to Al wiring 170*b*, via a contact hole, and N+ layer 168 is connected to Al wiring 170*c*, via anther contact hole. FIG. 16 illustrates a case wherein wiring 170*a*-170*b* is cut by laser. When no laser cut is effected, wiring 170*b* continues wiring 170*a*.

According to the configuration of FIG. 16, any circuit element other than a trimming resistor body can be built i the specific area of epitaxial layer 162 surrounded by N+ layers 166, 164, and 168. In this case, these N+ layers can serve not only as trimming resistor but also as element isolation layers with respect to other circuit elements formed in the same substrate.

The present invention can be suitably used for trimming a resistor array in an A/D converter or an operational amplifier, which is formed in a monolithic IC or in hybrid IC.

There is a Japanese Patent Application No. 63-10293 filed at the Japanese Patent Office on Jan. 20, 1988. The invention of this Japanese Patent Application can be used together with the present invention. The inventor of this Japanese Patent Application is the same as that of the present patent application. New US and EPC patent applications corresponding to the above Japanese Patent Application have already been filed. All disclosures of the above new US or EPC patent application are incorporated in the specification of the present invention. Data (filling date and filling number) of the above new US or EPC patent application will be updated later.

As described above, in the trimming resistor network of this invention, the trimming resistor is formed of a polysilicon film doped with impurity or nichrome-series alloy or the like which has lower heat conductivity than a metal such as Al. Therefore, in cutting off the trimming resistor, the trimming can be effected without destroying the underlying layer.

Further, when a microcrack has occurred in the fracture portion, no current flows in the fracture portion after the cutting operation. Therefore, the problem of variation in the resistance with time can also be solved.

With the use of the network of this invention, since a desired resistance variation unit can always be attained in the trimming operation, it becomes possible to easily and precisely adjust the output characteristic of the integrated circuit.

Further, in the network of this invention, a degree of freedom for determination of the resistances of resistors for attaining a desired effect is large and therefore the occupied area required for forming the network can be reduced.

While the invention has been described in connection with what is presently considered to be the most practical and preferred embodiment, it is to be understood that the invention is not limited to the disclosed embodiment but, on the contrary, is intended to cover various modifications and equivalent arrangements included within the scope of the appended claims, which scope is to be accorded the broadest interpretation so as to encompass all such modifications and equivalent arrangements.

What is claimed is:

1. A trimming resistor network comprising:

a pre-stage 4-terminals circuit block having first and second input terminals;

a plurality of succeeding-stage 4-terminals circuit blocks cascade-connected with said pre-stage 4-terminals circuit block, an internal circuit construction of at least part of said plurality of succeeding-stage 4-terminal circuit blocks being different from an internal circuit construction of said pre-stage 4-terminal circuit block, and the final stage of said succeeding-stage 4-terminal circuit block having first and second output terminals; and a load circuit terminating said first and second output terminals, wherein the internal circuit construction of at least part of said plurality of succeeding-stage 4-terminal circuit blocks includes a trimming resistor element which is cut off by a predetermined trimming operation.

2. A resistor network according to claim 1, wherein said pre-stage 4-terminal circuit block includes a resistance component connected in series with at least one of said first and second terminals.

3. A resistor network according to claim 1, wherein said pre-stage 4-terminal circuit block includes a resistance component connected between said first and second terminals.

4. A resistor network according to claim 1, wherein the internal circuit construction of at least part of said plurality of succeeding-stage 4-terminal circuit blocks includes a serial resistance component serially connected in a first circuit connecting said first input terminal to said first output terminal and a parallel resistance component connected between said first circuit and a second circuit which connects said second input terminals to said second output terminals.

5. A resistor network according to claim 1, wherein the internal circuit construction of at least part of said plurality of succeeding-stage 4-terminals circuit blocks includes a first serial resistance component serially connected in a first circuit connecting said first input terminals to said first output terminals; a second serial resistance component serially connected in a second circuit connecting said second input terminals to said second output terminal; and parallel resistance component connected between said first and second circuits.

6. A resistor network according to claim 1, wherein the internal circuits of said plurality of succeeding-stage 4-termianls circuit blocks each include a trimming resistor element which is formed in an integrated circuit and is cut off by a predetermined trimming operation.

7. A resistor network according to claim 6, wherein at least part of said trimming resistor element is formed of one selected from a group consisting of a polysilicon film doped with impurity, nichrome-series alloy film, tantalum-series metal film, polyimide organic film, acrylonitrile organic film, and ruthenium-series oxide film.

8. A trimming resistor network comprising:

first and second external connection terminals;

a first resistor having two ends acting as first and second connection terminals;

a first coupling body connecting said first external connection terminals to said first connection terminals via series-connected resistors;

a second coupling body connecting said second external connection terminal to said second connection terminal directly or via series-connected resistors; and parallel trimming resistors having two ends respectively connected to said first and second coupling bodies;

wherein the combined resistance between said first and second external connection terminals is increased by substantially a preset amount each time one of said parallel trimming resistors is cut off.

9. A trimming resistor network according to claim 8, wherein said parallel trimming resistors are formed of a resistor film which is one of a polysilicon film doped with impurity, nichrome-series alloy film, tantalum-series metal film, polyimide organic film, acrylonitrile organic film, and ruthenium-series oxide film.

* * * * *